United States Patent [19]

Taber

[11] 3,975,839

[45] Aug. 24, 1976

[54] FOOTWEAR

[75] Inventor: George J. Taber, Buffalo, N.Y.

[73] Assignee: Tractioneers, Inc., Buffalo, N.Y.

[22] Filed: Mar. 12, 1975

[21] Appl. No.: 557,796

[52] U.S. Cl. ..... 36/86; 36/44

[51] Int. Cl.[2] ..... A43B 13/38

[58] Field of Search ..... 36/2.5 J, 43, 44, 71, 36/2.5 R

[56] References Cited

UNITED STATES PATENTS

| | | | |
|---|---|---|---|
| 34,702 | 3/1862 | Sloan | 36/44 |
| 148,770 | 3/1874 | Stanton | 36/44 |
| 154,592 | 9/1874 | Edwards | 36/2.5 J |
| R3,944 | 4/1870 | Williams | 36/44 |

*Primary Examiner*—Patrick D. Lawson

*Attorney, Agent, or Firm*—Shlesinger, Fitzsimmons & Shlesinger

[57] ABSTRACT

Hard or soft wood of veneer-like thickness, and having the form of footwear insoles, fillers, liners, midsoles, outsoles, and of inserts, is incorporated as a structural component of boots, overshoes, shoes, slippers, and sneakers. These wooden component may extend for the full length of the footwear, or be just an insert disposed at the toe portion thereof, or at the toe and instep. These wooden components may or may not be treated with elastic sealants, or strengthened with heat-bonded thermoplastics, and they may be disposed in footwear with their grains extending laterally or longitudinally of the footwear.

10 Claims, 7 Drawing Figures

FOOTWEAR

The present invention relates to footwear, and more particularly to athletic shoes.

In athletic play, such as baseball, basketball, football, track, handball, squash or tennis, the conventionally constructed flexible shoes render a wearer's feet to liability of damaging in-shoe slippages and stresses injurious to bone, cartilage, musculeotendonous structure and soft tissues when an abrupt stop or turn is made, or on push-off, or when a toe is stubbed. The insoles and fillers used conventionally are susceptible to wetness and wrinkling, and to being misshapened by perspiration, pressures or wet weather. Athletes have had to tighten the shoes lacings too tightly is misdirected efforts to overcome faulty flexibilities and stiffnesses, only to incur foot injuries and deformations. Shoes intended for general wear are likewise faulty and detrimental.

A primary object of the present invention is to provide a shoe that has a greater degree of stiffness laterally, and a greater degree of flexibility longitudinally, particularly in the toe and ball areas of the footwear.

Another object of the invention is to provide means for limiting or inhibiting rotational flexibility (twisting) of a shoe throughout its instep area, decreasing torque and dissipating stresses.

Another object of the invention is to provide lighter and more compliant arch means for supporting the instep portion (arch) of footwear.

Another object of the invention is to provide means that limit the flexibility of footwear in the toe area.

Another object of the invention is to provide a footwear component that is light in weight, wrinkle-free and unaffected by moisture or low temperature.

Still another object of the invention is to provide means minimizing heat and cold transfer from the outsole of a shoe to the wearer'foot.

A still further object of the invention is to provide means for improving the fit of footwear and avoiding in-sole slippages, workages, and stresses.

Other objects of the invention will be apparent hereinafter from the specification and from the recital of the appended claims, particularly when read in conjunction with the accompanying drawing.

Figure 1:
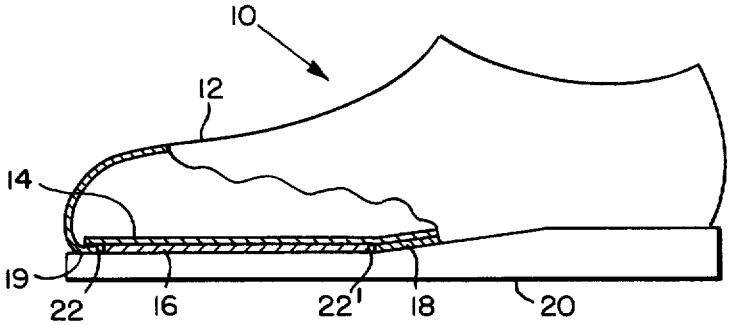
FIG. 1 is an elevational, part vertical sectional, view through a shoe made according to one embodiment of this invention.

Referring now to the drawing by numerals of reference, 10 denotes a shoe made according to one embodiment of this invention and comprising an upper 12, a liner 14, a wooden filler 16 disposed in the toe and ball area, still another wooden filler 18 disposed in the instep and heel areas, and an outsole 20. The upper is made in conventional fashion, for instance, of leather and pulled over at the toe, as denoted at 19, and sewed or otherwise fastened to the outsole 20. The filler 16 is separated at front and back from the inturned part of the upper and from filler 18, respectively, as denoted at 22 and 22', respectively.

The fillers 16 and 18 may be made from hard or soft wood, depending upon the conditions to be encountered in wear of the shoe. A hard wood will conduct heat faster than a soft wood; and a hard wood is stiffer than a soft wood. A soft wood, which may be used, for instance, may be made of ash or poplar.

Figure 2:
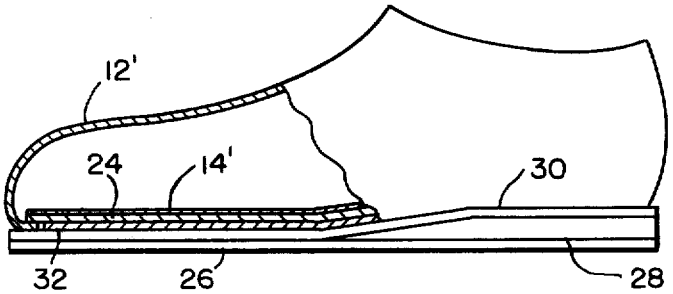
FIG. 2 is an elevation, partially broken away, of a shoe made according to another embodiment of this invention.

In the shoe shown in FIG. 2, a wooden insole 24 extends the length and width of the shoe in a one-piece construction that overlaps the pull over stock of the upper 12'. The liner 14' is disposed over the length and breadth of the insole 24. The tread (outsole) 26 is attached to cushioning means and the midsole 30. The shoe may have a filler 32 made from wood or a conventional material. The mi sol, liner, and insole 24 may be cemented or stitched together.

Figure 3:
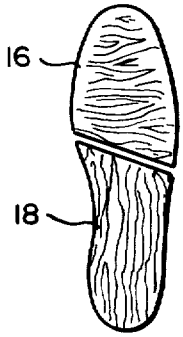
FIG. 3 is a plan view of a two-part wooden component such as may be used in a shoe made according to the invention.

FIG. 3 shows fillers 16 and 18 having their grains disposed at right angles, the grain of filler 16 extending transversely of the shoe, and the grain of filler 18 extending longitudinally. Filler 16 fills the toe and ball area of the shoe; and the filler 18 fills the instep (arch) and heel area.

Figure 4:
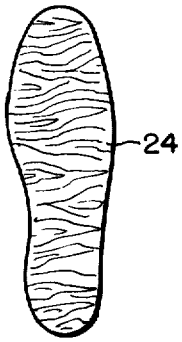
FIG. 4 is a plan view of one form of wooden component of a shoe made according to this invention and intended to extend the full length of the shoe or of the wearer's foot.

FIG. 4 shows a wooden filler so selected and disposed in the shoe that its grain extends transversely of the shoe.

These filler and insole components are of veneer-like thicknesses (0.020 to 0.200 inch) and have high degrees of flexibility when flexed crosswise of the wood grain; and they also have high degrees of stiffness when flexed longitudinally of the grain. Woods of low density transmit heat at the lowest rates and are most pliable. In some applications, wooden components intended to have flexibility are treated with elastic sealants. In other applications, wooden components needing high strength or limited pliability are reinforced with thermoplastics which are heat-bonded thereto. This may be done before the wooden filler is die-cut from a sheet and may be done for the full length of the filler or only for the instep and heel parts.

In applications such as liners, insoles, midsoles and outsoles, the areas intended to flex may be treated with elastic sealants or areas not intended to flex may be reinforced with thermoplastics. In areas were stitching is done, thermoplastic reinforcements may be used.

Figure 5:
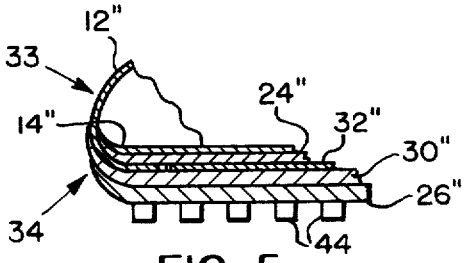
FIG. 5 is a fragmentary vertical sectional view through the ball area of a shoe illustrating a further embodiment of this invention.

FIG. 5 shows fragmentarily an improvement on the football shoe disclosed in my pending U.S. patent application Ser. No. 523,656, filed Nov. 14, 1974, now U.S. Pat. No. 3,932,950, issued Jan. 20, 1976. Intended for use on artificial turf, this shoe, which is denoted at 33, has an upper 12'', liner 14'', insole 24'', filler 32'', the midsole 30'', and outsole 26''. Skiving (tapering) of the insole edge enables insole 24'', upper 12'' and liner 14'' to flex. The midsole 30'' and outsole 26'' are flexible enabling their edges to conform with upper 12'' flexures at 34. Because of the flexures at 34, and of the stiffness across the shoe imparted by the insole 24'' and filler 32'', it will be evident the foot conforming radii provided thereby serve to inhibit in-shoe slippages and workages and their sequellae, and detrimental loadings on the metatarsals and the phalanges are minimized. If a wearer requires a tighter fit in the ball area of the shoe, or desires additional stiffness or support means that maximize the heat flow blocking properties, the liner 14'' (cotton drill) may be backed with a wooden component skived in conformance with the insole 24''. The outsole 26'', like that illustrated and described in my said U.S. Pat. No. 3,932,950, is made of natural or artificial rubber and is formed with protrusions or projections 44 for gripping the turf to provide a better grip for the football player on the turf, natural or artificial. The protrusions 44 are preferably integral with outsole, as described in said application.

Figure 6:
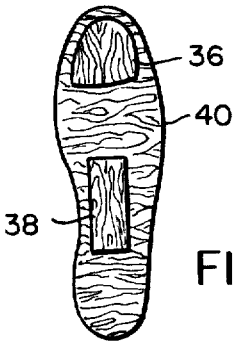
FIG. 6 is a fragmentary bottom view illustrating a still further type of wood component that may be used with this invention.
Figure 7:
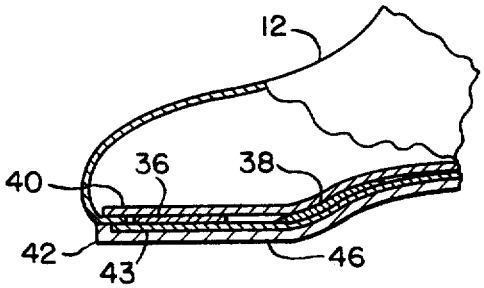
FIG. 7 is a part elevational, part sectional view of a shoe having the wooden component of FIG. 6.

In FIG. 6, the fillers 36 and 38 have grains that extend longitudinally of the shoe, and crosswise to the grain of insole filler 40. In FIG. 7, the filler 36 extends to the rear sufficiently to negate toe-cap breakdowns, or a development of outsole flexures resulting in wrinkles that disfigure a shoe or chafe a wearer's toes. A filler 38, that may be made flat in other adaptations, has a curvature in its instep area duplicative of a shoe-last curvature and has a stiffness preserving the shoe's curvature, similar to conventional steel arch-support means, which, however, greatly exceed a wooden arch, support weightwise. The outsole 42 is of a composite order comprised of a wooden lamination 43 that is bonded to tread material 46 made of stock suitable for either general indoor or outdoor use, or suitable for incorporation therewith of cleats or spikes such as used in sports. While outsole 42 is a light weight outsole suitable for a slipper, streetwear, or a track shoe, additional layers of wood attached thereto or above will decrease heat flow, provide a virtually puncture-proof shoe, or incorporate the stiffness essential for football field-goal and kick-off kicks.

The outer sole can be rubber or wood glued to foam.

The proposed wooden components are made from veneer-like woods such as commonly identified as hard or soft, and produced in thickness that equals or exceeds currently used, paper like, shoe board stocks. A curved component, as is filler 38, is produceable from wooden blocks; with appropriate rip-sawing means and techniques. As sneaker components, untreated woods may be used. In ultra-thin soled slipper or shoe applications, a single piece of wood or two or more woods with their grains disposed parallel or crosswise may be used; with or without a strengthening by thermoplastic means.

Both thickly and thinly soled shoes, found durable and most acceptable, have been produced with conventional shoe making means and with wooden materials and components of the orders herein described. These shoes have been extensively tested by professional athletes playing on hot and cold or wet and dry turfs; and they have been likewise tested in pedestrian hot-cold street wear.

The wood, as stated, may be ash, hickory or poplar, and because the grain runs across the foot will be very flexible axially but rather stiff in the transverse direction.

In the case of the shoe shown in FIG. 1, the wood insert itself may act as a shoe liner or spacer, but preferably has a nylon liner glued to its upper face, next to the foot of the wearer. The wooden insert may first be sprayed with latex and the nylon adhered thereto. Latex will partially impregnate the insert.

On the other hand, a piece of "Lexan" may be bonded to the wooden liner. The Lexan tends to prevent the wood from buckling.

A track shoe can be made with a wooden sole with Lexan laminated on the inside and outside; and the spikes for the running shoe may go through the Lexan. This makes a very light shoe. The steel spikes can be riveted right to the sole of the shoe for baseball or track shoes.

While the invention has been described, then, in connection with several different embodiments thereof, it will be understood that it is capable of further modification; and this application is intended to cover any modifications or embodiments of the invention that come within the scope of the invention or the limits of the appended claims.

Having thus described my invention, what I claim is:

1. An article of footwear comprising an upper, an outsole secured to said upper, a first wooden filler having its grain extending crosswise of the footwear and being disposed in the toe and ball areas of the footwear, and a second filler, whose grain extends longitudinally of the footwear, said second filler being disposed in the instep and heel areas of the footwear.

2. An article of footwear as claimed in claim 1, which has also a liner, and in which the fillers are disposed between the outsole and the liner.

3. An article of footwear, comprising an upper, an outsole secured to said upper, a first, thin, flexible layer of wood having at least a portion thereof disposed in the toe and ball areas of the footwear, and a second, thin, flexible layer of wood having at least a portion thereof disposed in the instep area of the footwear, one of said layers having its grain extending crosswise of the footwear, and the other of said layers having its grain extending longitudinally of the footwear.

4. An article of footwear as defined in claim 3, wherein said one layer extends the fully length and width of the footwear, and said other layer is positioned between said one layer and said outsole in the instep area of the footwear.

5. An article of footwear as defined in claim 4, wherein said other layer has a curvature duplicative of a shoe-last curvature.

6. An article of footwear as defined in claim 4, including a third, thin, flexible layer of wood disposed in the toe and ball areas of said foot between said one layer and said outsole, and forwardly of said other layer.

7. An article of footwear as defined in claim 6, including a fourth, thin, flexible layer of wood secured to the upper surface of said outsole beneath said other and said third layers of wood and extending substantially the full length and width of the footwear.

8. An article of footwear as defined in claim 3, wherein both of said layers extend the full length and width of the footwear, and said one layer is secured along its edge to the marginal edge of said upper.

9. An article of footwear as defined in claim 8, wherein said one layer constitutes the insole of the footwear and is tapered at the edge thereof which is secured to he edge of said upper, and a midsole is positioned between and secured to said insole and said outsole, respectively.

10. An article of footwear as defined in claim 9, wherein said outsole is made of rubber and has thereon a plurality of spaced, integral protrusions which project from the underside of said outsole to form turf-gripping means thereon.

* * * * *